US009102434B2

(12) United States Patent
Howell et al.

(10) Patent No.: US 9,102,434 B2
(45) **Date of Patent: *Aug. 11, 2015**

(54) CONTAINER HAVING COMPOUND FLEXIBLE PANELS

(75) Inventors: Justin A. Howell, New Cumberland, PA (US); Benton A. Lewis, Manchester, PA (US); Eric B. Ungrady, Mt. Wolf, PA (US); Sunil S. Shah, York, PA (US)

(73) Assignee: GRAHAM PACKAGING COMPANY, L.P., York, PA (US)

( * ) Notice: Subject to any disclaimer, the term of this patent is extended or adjusted under 35 U.S.C. 154(b) by 412 days.

This patent is subject to a terminal disclaimer.

(21) Appl. No.: 12/505,682

(22) Filed: Jul. 20, 2009

(65) Prior Publication Data

US 2011/0011825 A1 Jan. 20, 2011

(51) Int. Cl.
*B65D 90/02* (2006.01)
*B65D 1/02* (2006.01)
*B65D 79/00* (2006.01)

(52) U.S. Cl.
CPC ..... *B65D 1/0223* (2013.01); *B65D 79/005* (2013.01)

(58) Field of Classification Search
CPC ..... B65D 1/0223; B65D 79/005; B65D 2501/0036; B65D 2501/0081; B65D 2501/0027
USPC ..... 215/381, 379, 375, 373, 384; D9/538, D9/516, 539, 667; 220/400, 669, 672, 675
See application file for complete search history.

(56) References Cited

U.S. PATENT DOCUMENTS

| | | | | |
|---|---|---|---|---|
| 3,325,031 | A | 6/1967 | Singier | |
| 4,805,788 | A * | 2/1989 | Akiho | 215/381 |
| D321,830 | S * | 11/1991 | York et al. | D9/434 |
| 5,141,121 | A * | 8/1992 | Brown et al. | 215/381 |

(Continued)

FOREIGN PATENT DOCUMENTS

| | | |
|---|---|---|
| EP | 1561691 | 8/2005 |
| JP | 2005096850 | 4/2005 |

(Continued)

OTHER PUBLICATIONS

PCT International Search Report dated Oct. 22, 2010 for corresponding PCT/US2010/040857 filed Jul. 2, 2010.

*Primary Examiner* — Fenn Mathew
*Assistant Examiner* — Cynthia Collado
(74) *Attorney, Agent, or Firm* — Baker Botts L.L.P.

(57) ABSTRACT

A plastic container that is adapted for adjustment to internal volumetric changes such as those that occur as a result of internal pressure and temperature changes during the hot-fill process includes a container body defining an internal space. The container body has at least one flexible panel defined therein, which includes an outer flexible panel portion and an inner flexible panel portion. The outer flexible panel portion has a shape when a pressure equilibrium exists between the internal space and ambient external pressure, and is further constructed and arranged to assume a shape of increased concavity when a sufficient underpressure exists in the internal space. The inner flexible panel portion is constructed and arranged to flex relative to the outer flexible panel portion in order to accommodate internal pressure changes within the container body. The inner and outer flexible panel portions accordingly work in tandem to permit efficient vacuum uptake in a hot-fill type container. In addition, a boundary between the outer and inner flexible panel portions is preferably entirely curved.

20 Claims, 5 Drawing Sheets

(56) References Cited

U.S. PATENT DOCUMENTS

| | | | | |
|---|---|---|---|---|
| 5,341,946 | A * | 8/1994 | Vailliencourt et al. | 215/381 |
| 5,704,503 | A * | 1/1998 | Krishnakumar et al. | 215/381 |
| D395,826 | S | 7/1998 | Hygaard, Sr. | |
| D402,563 | S | 12/1998 | Prevot et al. | |
| 5,908,128 | A * | 6/1999 | Krishnakumar et al. | 215/381 |
| 5,971,184 | A * | 10/1999 | Krishnakumar et al. | 215/384 |
| D419,872 | S | 2/2000 | Lane | |
| D420,593 | S | 2/2000 | Denner et al. | |
| 6,036,037 | A * | 3/2000 | Scheffer et al. | 215/381 |
| D423,936 | S | 5/2000 | Smith et al. | |
| D424,446 | S | 5/2000 | Silvers et al. | |
| D428,815 | S | 8/2000 | Mooney et al. | |
| D442,866 | S | 5/2001 | Mooney et al. | |
| D443,521 | S | 6/2001 | Bansal et al. | |
| D448,303 | S | 9/2001 | Cheng et al. | |
| D448,304 | S | 9/2001 | Cheng et al. | |
| D454,792 | S | 3/2002 | Keller | |
| 6,439,413 | B1 | 8/2002 | Prevot et al. | |
| 6,460,714 | B1 * | 10/2002 | Silvers et al. | 215/381 |
| D467,813 | S | 12/2002 | Silvers et al. | |
| D496,281 | S | 9/2004 | Trude | |
| D505,077 | S | 5/2005 | Piccioli et al. | |
| 6,935,525 | B2 | 8/2005 | Trude | |
| 7,014,056 | B2 | 3/2006 | Trude | |
| 7,073,675 | B2 | 7/2006 | Trude | |
| 7,137,520 | B1 * | 11/2006 | Melrose | 215/381 |
| D542,666 | S | 5/2007 | Trude | |
| D560,503 | S | 1/2008 | Siriporn | |
| D561,037 | S | 2/2008 | Boon | |
| D592,964 | S | 5/2009 | Kissinger et al. | |
| D598,779 | S | 8/2009 | Lepoitevin | |
| D612,250 | S | 3/2010 | Shah | |
| 8,627,944 | B2 * | 1/2014 | Kelley et al. | 198/471.1 |
| 2005/0121408 | A1 * | 6/2005 | Deemer et al. | 215/381 |
| 2006/0157439 | A1 | 7/2006 | Howell | |
| 2007/0075032 | A1 | 4/2007 | Kelley et al. | |
| 2007/0090083 | A1 | 4/2007 | Trude | |
| 2007/0125743 | A1 | 6/2007 | Pritchett, Jr. et al. | |
| 2007/0257004 | A1 | 11/2007 | Howell et al. | |
| 2008/0093329 | A1 | 4/2008 | Mooney | |
| 2012/0267381 | A1 * | 10/2012 | Trude et al. | 220/675 |

FOREIGN PATENT DOCUMENTS

| | | | |
|---|---|---|---|
| WO | 2006/039523 | A1 | 4/2006 |
| WO | 2008130987 | | 10/2008 |

* cited by examiner

FIG. 3
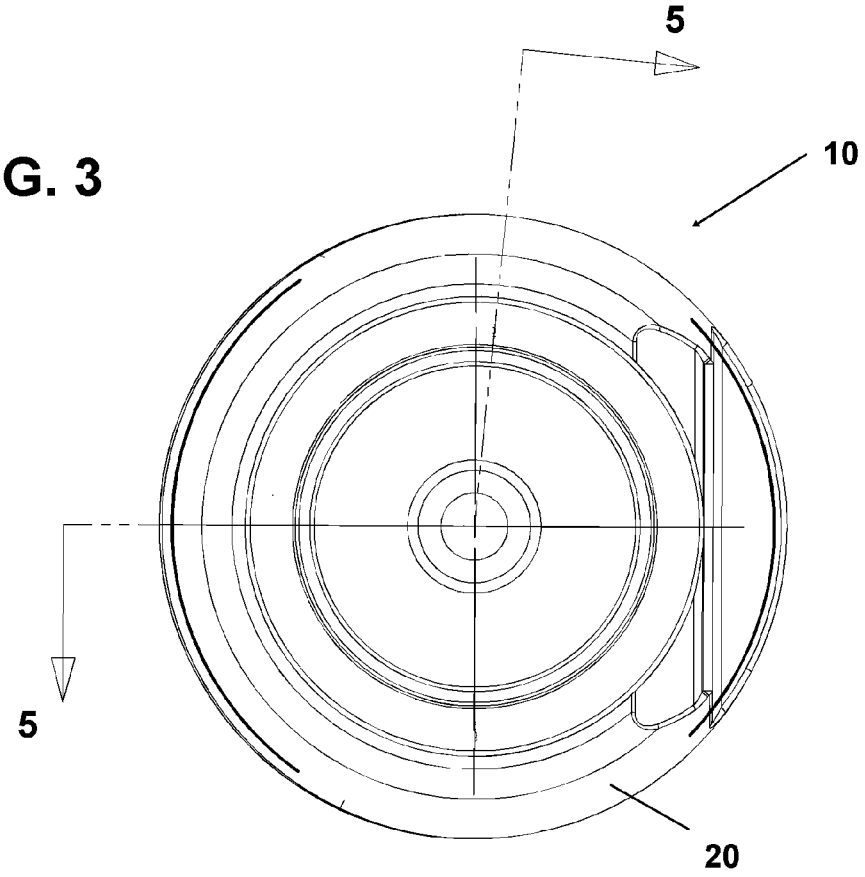
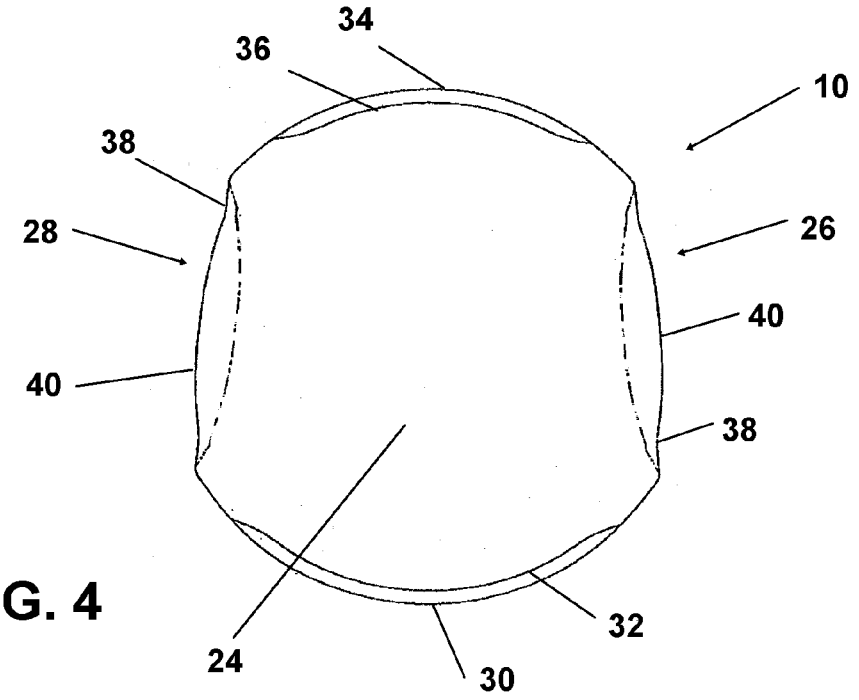
FIG. 4

CONTAINER HAVING COMPOUND FLEXIBLE PANELS

BACKGROUND OF THE INVENTION

1. Field of the Invention

This invention relates generally to the field of plastic containers, and more particularly to plastic containers that are designed to accommodate volumetric expansion and contraction such as that inherent to the hot-fill packaging process or to packaging applications where internal pressurization is anticipated.

2. Description of the Related Technology

Many products that were previously packaged using glass containers are now being supplied in plastic containers, such as containers that are fabricated from polyesters such as polyethylene terephthalate (PET).

PET containers are typically manufactured using the stretch blow molding process. This involves the use of a preform that is injection molded into a shape that facilitates distribution of the plastic material within the preform into the desired final shape of the container. The preform is first heated and then is longitudinally stretched and subsequently inflated within a mold cavity so that it assumes the desired final shape of the container. As the preform is inflated, it takes on the shape of the mold cavity. The polymer solidifies upon contacting the cooler surface of the mold, and the finished hollow container is subsequently ejected from the mold.

Hot fill containers are designed to be used with the conventional hot fill process in which a liquid or semi-solid product such as fruit juice, sauce, salsa, jelly or fruit salad is introduced into the container while warm or hot, as appropriate, for sanitary packaging of the product. After filling, such containers undergo significant volumetric shrinkage as a result of the cooling of the product within the sealed container. Hot fill type containers accordingly must be designed to have the capability of accommodating such shrinkage. Typically this has been done by incorporating one or more vacuum panels into the side wall of the container that are designed to flex inwardly as the volume of the product within the container decreases as a result of cooling.

Typically, the vacuum panel regions of conventional hot fill containers are characterized by having surfaces that are designed to deflect inwardly when the product within the sealed container undergoes shrinkage. In some instances, an inflexible island may be defined in the middle of the vacuum panel in order to provide support for an adhesive label that may be placed over the container. Grippability for the consumer is also an important consideration in the design of many containers.

The amount of volumetric contraction, also referred to as vacuum uptake, that can be provided by a conventional vacuum panel is limited by the size of the panel. The design of such containers is often influenced by the aesthetic preferences of manufacturers, which in some instances can limit the size of the vacuum panels to the extent that makes it difficult or impossible to achieve the necessary vacuum uptake capacity.

A need therefore exists for an improved vacuum panel configuration that achieves a maximal amount of vacuum uptake capacity in relation to the size of the vacuum panel.

SUMMARY OF THE INVENTION

Accordingly, it is an objection of the invention to provide an improved vacuum panel configuration that achieves a maximal amount of vacuum uptake capacity in relation to the size of the vacuum panel.

In order to achieve the above and other objects of the invention, a plastic container according to a first aspect of the invention that is adapted for adjustment to internal volumetric changes includes a container body defining an internal space. The container body has at least one flexible panel defined therein that includes an outer flexible panel portion and an inner flexible panel portion. The outer flexible panel portion has a shape when a pressure equilibrium exists between the internal space and ambient external pressure, and is further constructed and arranged to assume a more concave shape when a sufficient underpressure exists in the internal space. The inner flexible panel portion is located within the outer flexible panel portion, and is constructed and arranged to flex relative to the outer flexible panel portion in order to accommodate internal pressure changes within the container body.

A plastic container that is adapted for adjustment to internal volumetric changes, according to a second aspect of the invention includes a container body defining an internal space. The container body has at least one flexible panel defined therein that includes an outer flexible panel portion and an inner flexible panel portion. The inner flexible panel portion is located within the outer flexible panel portion, and an entire boundary between said outer flexible panel portion and said inner flexible panel portion is curved These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

FIG. 3 is a bottom plan view of the container shown in FIG. 1;

FIG. 4 is a diagrammatical cross-sectional view taken along lines 4-4 in FIG. 2, showing the container during unstressed conditions and during vacuum uptake conditions in broken lines;

DETAILED DESCRIPTION OF THE PREFERRED EMBODIMENT(S)

Figure 1:
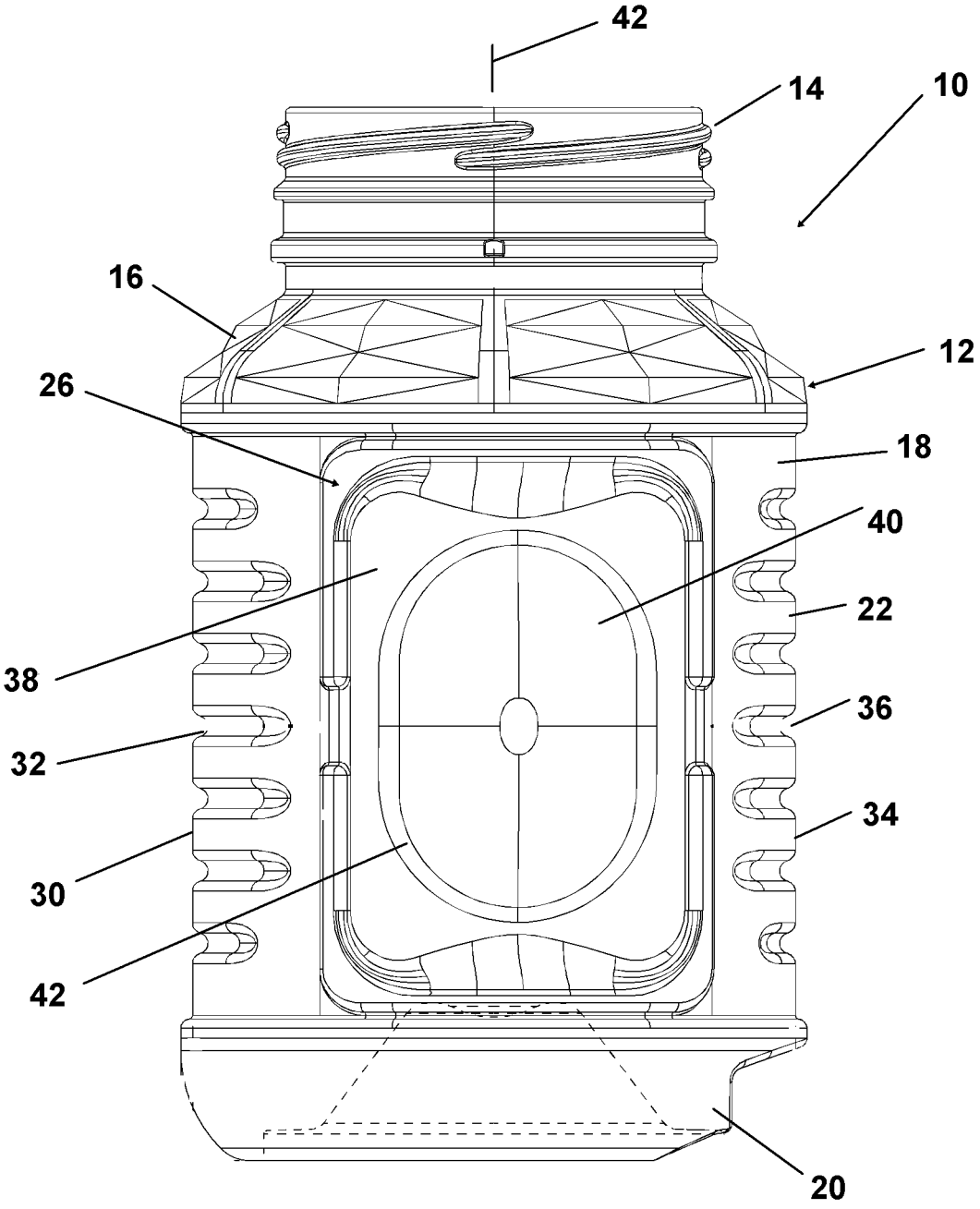
FIG. 1 is a side elevational view of a container that is constructed according to a first preferred embodiment of the invention.
Figure 2:
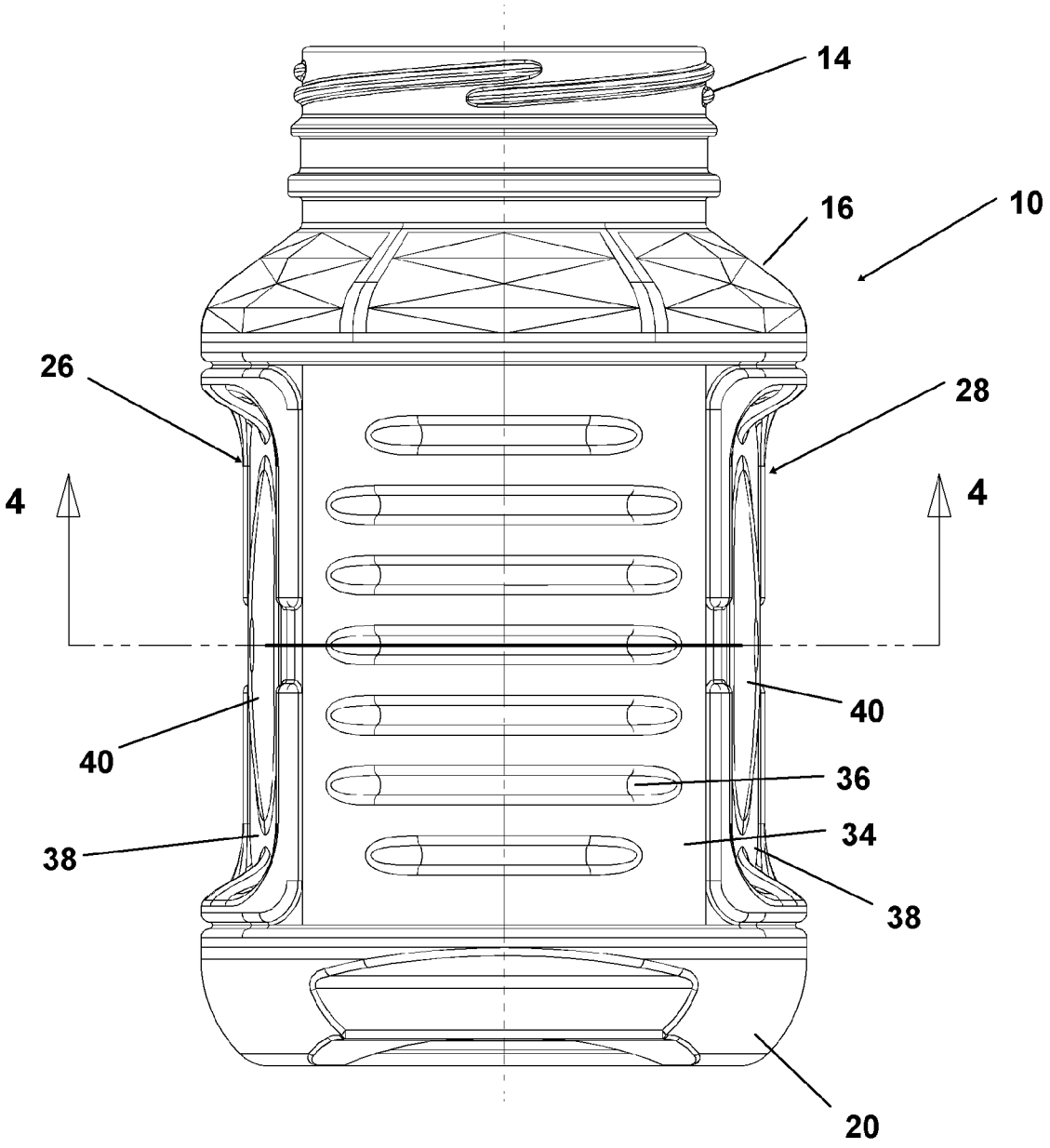
FIG. 2 is a front elevational view of the container shown in FIG. 1.
Figure 5:
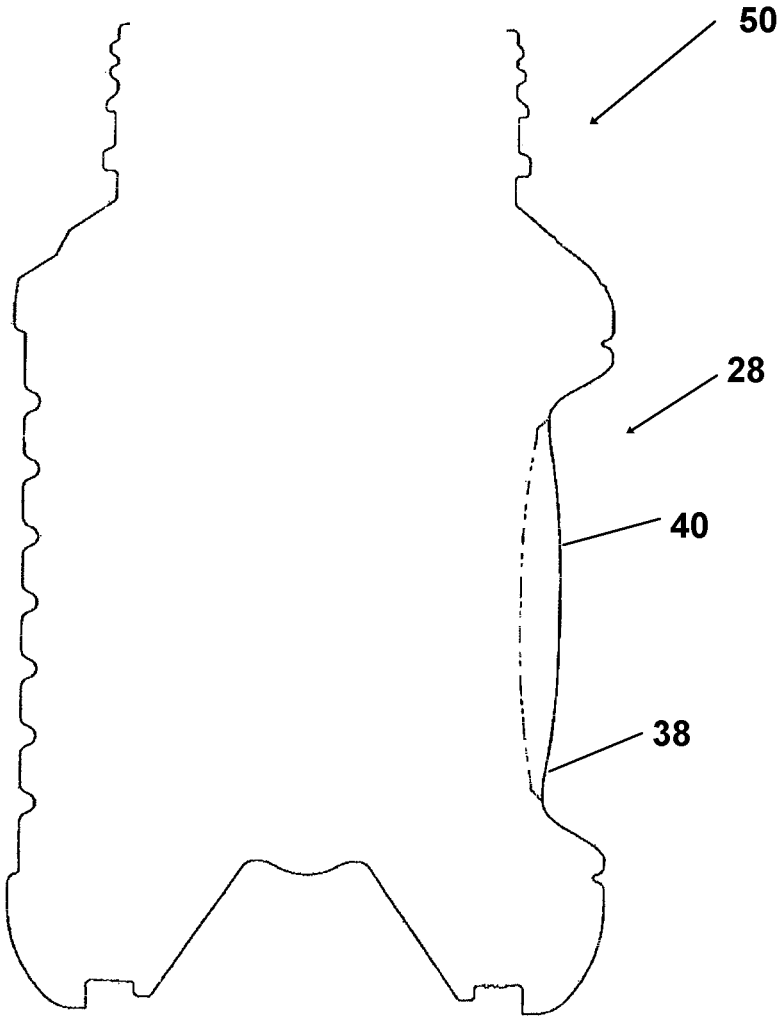
FIG. 5 is a diagrammatical cross-sectional view taken along lines 5-5 in FIG. 3, showing the container during unstressed conditions and during vacuum uptake conditions in broken lines.

Referring now to the drawings, wherein like reference numerals designate corresponding structure throughout the views, and referring in particular to FIG. 1, plastic container 10 that is constructed according to a first preferred embodiment of the invention is designed to accommodate volumetric expansion and contraction such as that which is inherent to the hot-fill packaging process or to packaging applications where internal pressurization is anticipated.

Container 10 includes a container body 12, which is preferably fabricated out of a material such as polyethylene terephthalate (PET) using a conventional stretch blow molding process. Container body 12 defines a longitudinal axis 42 and preferably includes a threaded finish portion 14 that defines an opening that is in communication with an internal space 28 that is defined within the container body 12. Finish portion 14 is adapted to receive a conventional closure (not shown) in order to seal the container 10 after filling by the manufacturer and between uses by the consumer. Container body 12 further preferably includes a neck or shoulder portion 16, a main body portion 18 and a bottom portion 20.

The container body 12 and in particular the main body portion 18 is molded so as to have a thin sidewall 22. The portion of the sidewall 22 that defines the main body portion 18 is shaped so that the outermost surfaces thereof are substantially cylindrical. The sidewall 22 is preferably configured and shaped so as to have at least one flexible panel 26 defined therein. In the preferred embodiment that is shown in FIGS. 1-5, sidewall 22 defines a first flexible panel 26 and a second flexible panel 28. The flexible panels 26, 28 in the preferred embodiment are recessed to an extent that they permit and facilitate a consumer to securely grip the plastic container using the recessed areas of the panels 26, 28 as handholds for the thumb and fingers while pinching the container body 12.

Sidewall 22 further defines a first sidewall portion 30 on a rear side of the container 10, which is provided with a plurality of concave ribs or grooves 32. A second sidewall portion 34 is similarly provided on a front side of the container 10, which is likewise provided with a plurality of concave ribs or grooves 36. The presence of the ribs or grooves 32, 36 on the respective first and second sidewall portions 26, 28 provides rigidity to a degree that prevents any substantial flexure of either sidewall portion 26, 28 as a result of the magnitude of pressure differential between the internal space 28 and ambient pressure that is expected to occur during the filling process or in subsequent handling of the container 10 by the manufacturer or the consumer.

Each of the flexible panels 26, 28 preferably includes an outer flexible panel portion 38 that has a shape that is flat, convex or concave in the unstressed position wherein a pressure equilibrium exists between the internal space 28 and ambient external pressure. In other words, the outer flexible panel portion 38 may be substantially flat, concave or convex under pressure equilibrium conditions. Preferably, however, the outer flexible panel portion 38 is flat or convex in the unstressed position. The outer flexible panel portion 38 is further constructed and arranged to increase in concavity when a sufficient underpressure exists in the internal space 28. In the preferred embodiment, it assumes a concave shape when a sufficient underpressure exists in the internal space 28. This underpressure, expressed as a difference between the internal and external pressures, is preferably within a range of about 0.5 psi to about 10.0 psi, and more preferably within a range of about 1.0 psi to about 6.0 psi.

Figure 6:
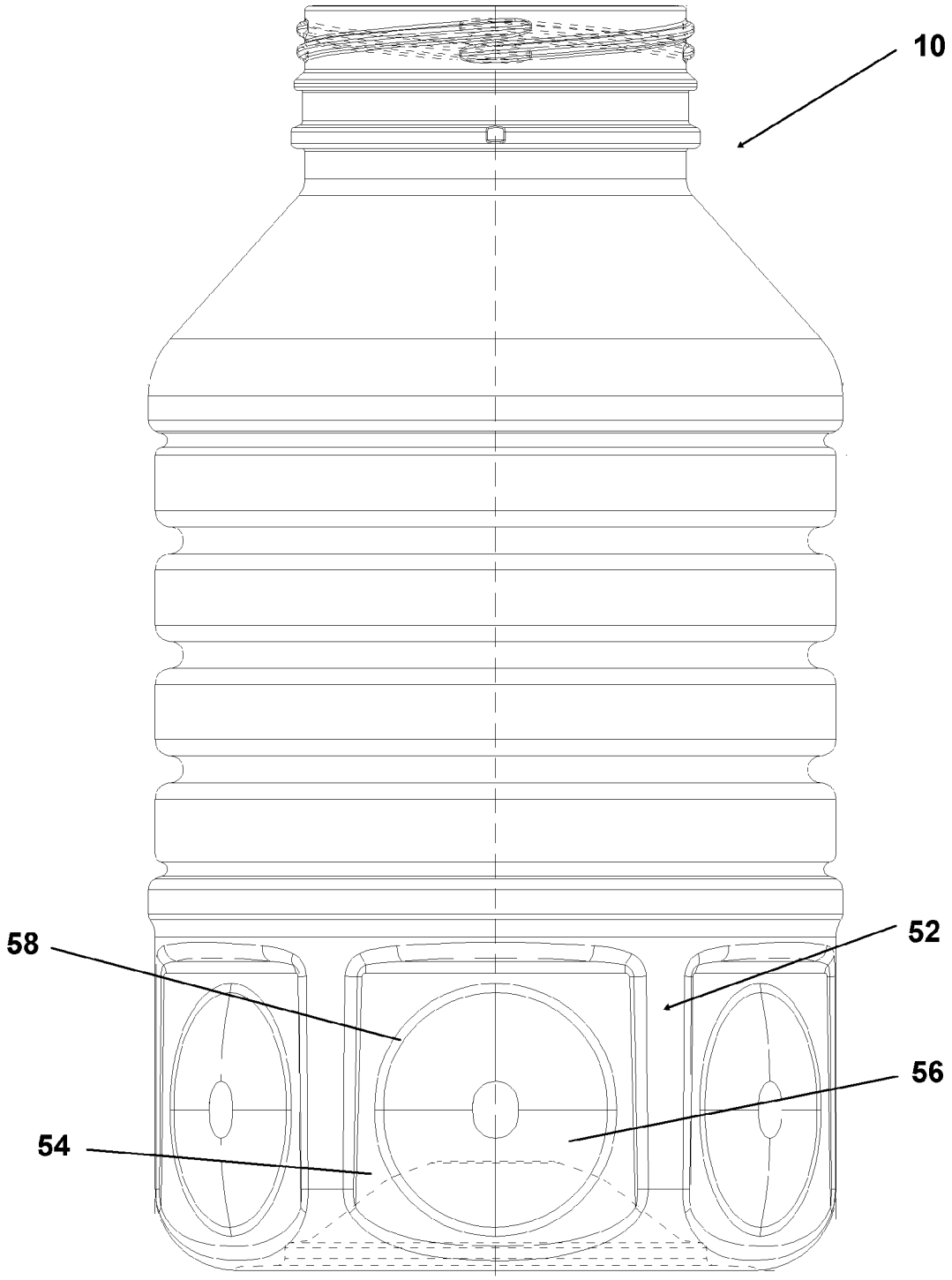
FIG. 6 is a side elevational view of a container that is constructed according to a second embodiment of the invention.

Each of the flexible panels 26, 28 preferably also includes an inner flexible panel portion 40 that is located within the outer flexible panel portion 38 and defines a boundary 42 with respect thereto. The entire boundary 42 between the outer flexible panel portion 38 and the inner flexible panel portion 40 is preferably curved as viewed in side elevation. In the embodiment shown in FIGS. 1-5, the boundary 42 is substantially oval-shaped. In the embodiment shown in FIG. 6, a container 50 is shown having a flexible panel 52 in which a boundary 58 between an outer flexible panel portion 54 and an inner flexible panel portion 56 is substantially circular-shaped.

The inner flexible panel portion 40 is constructed and arranged to flex relative to the outer flexible panel portion 38 and the rest of the container 10 in order to accommodate internal pressure changes within the container body 10. More specifically, the inner flexible panel portion 40 preferably extends radially outwardly with respect to the outer flexible panel portion 38. In the preferred embodiment it has a relatively smooth, convex shape as viewed both along a longitudinal plane and along a transverse plane when it is in the unstressed position in which internal pressure is substantially equal to external pressure. As shown in FIG. 4, the inner flexible panel portion 40 is further constructed and arranged to assume a relatively flat shape or to invert to a concave shape when a sufficient underpressure, the extent described above, exists in the internal space 28.

The inner flexible panel portion 40 defines a first surface area, and the outer flexible panel portion 38 defines a second surface area. A ratio of the first surface area to the second surface area is preferably within a range of about 0.5 to about 8.0. More preferably, this ratio is within a range of about 1.0 to about 6.0.

The inner and outer flexible panel portions 40, 38 accordingly work in tandem to permit more space-efficient vacuum uptake in a hot-fill type container than could be achieved using a single flat panel of comparable size.

In an alternative embodiment in which the invention is utilized to provide for the uptake of positive pressurization within the container, the inner flexible panel portion could be configured so that it is concave under equilibrium conditions, and flexes to a substantially flat shape or inverts or to a convex shape when a sufficient magnitude of positive internal pressurization is achieved.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A plastic container that is adapted for adjustment to internal volumetric changes, comprising:

a container body defining an internal space, said container body having a sidewall portion including at least one flexible panel defined therein, said flexible panel including:

an outer flexible panel portion surrounded by the sidewall portion and having a cross-sectional shape when a pressure equilibrium exists between an internal pressure within said internal space and ambient external pressure, said outer flexible panel portion further being constructed and arranged so that said cross-sectional shape increases in concavity relative to the sidewall portion when a sufficient underpressure exists in said internal space relative to the ambient external pressure;

an inner flexible panel portion located completely within and surrounded by said outer flexible panel portion, said inner flexible panel portion being constructed and arranged to flex relative to said outer flexible panel portion in order to accommodate internal pressure changes within the internal space of the container body; and a boundary between the inner and outer flexible panel portions.

2. A plastic container according to claim 1, wherein said inner flexible panel portion defines a first area and said outer flexible panel portion defines a second area, and wherein a ratio of said first area to said second area is within a range of about 0.5 to about 8.0.

3. A plastic container according to claim 2, wherein said ratio of said first area to said second area is within a range of about 1.0 to about 6.0.

4. A plastic container according to claim 1, wherein said boundary is oval-shaped in side view.

5. A plastic container according to claim 1, wherein said boundary is circular-shaped in side view.

6. A plastic container according to claim 1, wherein said flexible panel is recessed from the sidewall portion of said container body.

7. A plastic container according to claim 1, wherein at least two of said flexible panels are defined in said sidewall portion, and wherein said flexible panels are recessed to permit consumers to grip the plastic container.

8. A plastic container according to claim 1, wherein said container body defines a longitudinal axis, and wherein said inner flexible panel portion extends radially outwardly with respect to said outer flexible panel portion.

9. A plastic container according to claim 1, wherein an outermost surface of said sidewall portion is shaped so as to be substantially cylindrical.

10. A plastic container according to claim 1, wherein said container body is fabricated from a material comprising polyethylene terephalate.

11. A plastic container that is adapted for adjustment to internal volumetric changes, comprising:

a container body having a sidewall including at least one flexible panel defined therein, said flexible panel including:

an outer flexible panel portion having an outer boundary surrounded by a surrounding sidewall portion and a cross-sectional shape when a pressure equilibrium exists between an internal pressure within said internal space and ambient external pressure, said outer flexible panel portion constructed and arranged so that said cross-sectional shape changes relative to the surrounding sidewall portion when a sufficient underpressure exists in said internal space relative to the ambient external pressure;

an inner flexible panel portion located completely within and surrounded by said outer flexible panel portion, the inner flexible panel portion constructed and arranged to flex relative to the outer flexible panel portion in response to the underpressure within the container; and a boundary between the inner and outer flexible panel portions.

12. A plastic container according to claim 11, wherein said inner flexible panel portion defines a first area and said outer flexible panel portion defines a second area, and wherein a ratio of said first area to said second area is within a range of about 0.5 to about 8.0.

13. A plastic container according to claim 12, wherein said ratio of said first area to said second area is within a range of about 1.0 to about 6.0.

14. A plastic container according to claim 11, wherein an outermost surface of said sidewall is shaped so as to be substantially cylindrical.

15. A plastic container according to claim 11, wherein said boundary between the inner and outer flexible panel portions is oval-shaped in side view.

16. A plastic container according to claim 11, wherein said boundary between the inner and outer flexible panel portions is circular-shaped in side view.

17. A plastic container according to claim 11, wherein said flexible panel is recessed from the surrounding sidewall portion of said container body.

18. A plastic container according to claim 17, wherein at least two of said flexible panels are defined in said sidewall, and wherein said flexible panels are recessed to permit consumers to grip the plastic container.

19. A plastic container according to claim 11, wherein said container body defines a longitudinal axis, and wherein said inner flexible panel portion extends radially outwardly with respect to said outer flexible panel portion.

20. A plastic container according to claim 11, wherein said container body is fabricated from a material comprising polyethylene terephalate.

* * * * *